US007739991B2

(12) United States Patent
Kotani et al.

(10) Patent No.: US 7,739,991 B2
(45) Date of Patent: Jun. 22, 2010

(54) ADJUSTABLE VALVE DRIVE DEVICE OF ENGINE

(75) Inventors: Toshimasa Kotani, Hiroshima (JP); Hirokazu Matsuura, Hiroshima (JP); Shinichi Sugihara, Hiroshima (JP)

(73) Assignee: Mazda Motor Corporation (JP)

( * ) Notice: Subject to any disclaimer, the term of this patent is extended or adjusted under 35 U.S.C. 154(b) by 295 days.

(21) Appl. No.: 12/013,526

(22) Filed: Jan. 14, 2008

(65) Prior Publication Data

US 2008/0184946 A1 Aug. 7, 2008

(30) Foreign Application Priority Data

Feb. 6, 2007 (JP) ..... 2007-026694

(51) Int. Cl.
*F01L 1/18* (2006.01)

(52) U.S. Cl. ..... 123/90.44; 123/90.16; 123/90.39; 123/90.48; 123/90.6; 74/559; 74/569

(58) Field of Classification Search ..... 123/90.16, 123/90.39, 90.44, 90.48, 90.6; 74/559, 567, 74/569

See application file for complete search history.

(56) References Cited

U.S. PATENT DOCUMENTS 6,378,474 B1 4/2002 Pierik
6,382,150 B1 5/2002 Fischer
6,386,161 B2 5/2002 Pierik
6,694,934 B1 * 2/2004 Preston et al. ..... 123/90.16
2004/0237920 A1 12/2004 Nakamura et al.

FOREIGN PATENT DOCUMENTS

EP 1318280 A2 6/2003
EP 1338765 A2 8/2003
EP 1344904 A2 9/2003
JP 2004-301058 10/2004

OTHER PUBLICATIONS

European Search Report; EP08001956; Jul. 23, 2008.

* cited by examiner

*Primary Examiner*—Ching Chang
(74) *Attorney, Agent, or Firm*—Studebaker & Brackett PC; Donald R. Studebaker

(57) ABSTRACT

A rocker cam is comprised of a first split body and a second split body, which are joined with a joint split face that contains an axial line of a cam shaft. The first split body has a first pin support portion that supports one end portion of the connection pin, and the second split body has a second pin support portion that is located so as to face the first pin support portion and supports the other end portion of the connection pin. The connection pin is supported at the first and second pin support portions at its both end portions. Accordingly, a separation force that acts on the first and second split bodies of the rocker cam during its repeated rocking movement can be reduced without improperly increasing its rigidity.

3 Claims, 11 Drawing Sheets

ADJUSTABLE VALVE DRIVE DEVICE OF ENGINE

BACKGROUND OF THE INVENTION

The present invention relates to an adjustable valve drive device of an engine, and in particular relates to a technology for properly reducing a stress acting in a direction of separation of first and second split bodies that constitute a rocker cam.

It is generally known that a valve timing or a valve lift of intake and exhaust valves of an engine are changed according to an engine operation state. An example of such an adjustable valve drive device is disclosed in Japanese Patent Laid-Open Publication No. 2004-301058, in which an outer ring is provided so as to fit onto an eccentric cam that is provided at a cam shaft, a rocker cam operative to lift (drive) an intake valve is supported at the cam shaft so as to be rocking, the displacement of the outer ring according to rotation of the eccentric cam is transmittable to the rocker cam via a link mechanism that comprises a control link coupled to the outer ring and a link coupled to the rocker cam, and the distance between a rocker support point of the control link and an axial center of the rocker cam is changeable according to the engine operation state.

According to the above-described adjustable valve drive device, the valve opening start timing can be advanced and the valve lift can be increased by reducing the above-described distance at an engine high-speed and high-load state, while the valve opening start timing can be delayed and the valve lift can be reduced by increasing the above-described distance at an engine low-speed and low-load state.

Herein, the rocker cam for the control of the valve timing of the engine needs to be replaced with a new one when its cam profile face has come to wear off in order to maintain the proper performance.

In a multi-cylinder type of engine, however, since a plurality of rocker cams are provided for multi-cylinders, the replacing of the plural rocker cams may need rather troublesome works. For example, when an rocker cam that is located at the center of the engine is replaced, all adjacent rocker cams to this center rocker cam need to be removed first before the center rocker cam is removed from the cam shaft. Meanwhile, it is preferable in the multi-cylinder engine that the eccentric cam be integrally formed with the cam shaft to ensure a precise distance between adjacent cylinders from an aspect of proper assembling.

From the above-described perspectives, it may be considered that the rocker cam is comprised of a first split body with a cam profile face and a second split body without a cam profile, which are joined to one another by a fastening bolt.

Herein, in general, since a tappet for driving (opening) a valve or a cam follower of a rocker arm contact the cam profile face of the rocker cam, there occurs a relatively large acceleration to the rocker cam at a rising initial timing of the cam profile face, i.e., at a transient period from its base circle area to its cam nose area. Accordingly, in a case where the above-described link mechanism is coupled to either one of the first and second split bodies via a connection pin, an improperly large stress is generated between the first and second split bodies when the engine runs at a high speed. This may cause a concern that a joint split face of these bodies opens or slides.

Increasing of a fastening force of the above-descried fastening bolt or thickness of the split bodies for solving the above-described concern may cause another issue of a large size or a heavy weight of the rocker cam instead. Herein, it is preferable that the weight of the rocker cam be as light as possible because of the rocker cam's repeated rocking movement.

SUMMARY OF THE INVENTION

The present invention has been devised in view of the above-described matters, and an object of the present invention is to provide an adjustable valve drive device of an engine that can properly reduce a separation force that acts on the first and second split bodies of the rocker cam during its repeated rocking movement, without improperly increasing its rigidity.

According to the present invention, there is provided an adjustable valve drive device of an engine, comprising a drive shaft provided in parallel to a crank shaft of the engine, a rocker cam operative to drive a valve, the rocker cam being supported at the drive shaft so as to be rocking, and a link mechanism coupled to a connection pin that is attached to the rocker cam, the connection pin having a pin axis that is provided so as to extend in parallel to the drive shaft, the link mechanism being configured to change a valve lift characteristic by controlling a rocking range of the rocker cam according to an engine operation state, wherein the rocker cam comprises a first split body with a cam profile face and a second split body without a cam profile, which are joined to one another by a fastening bolt with a joint split face thereof that is formed so as to contain an axial line of the drive shaft thereon, the first split body having a first pin support portion that supports one end portion of the connection pin, the second split body having a second pin support portion that is located so as to face the first pin support portion of the first split body and supports the other end portion of the connection pin, whereby the connection pin is supported at the first and second pin support portions at both end portions thereof so as to extend between the first pin support portion of the first split body and the second pin support portion of the second split body.

According to the above-described structure, since the connection pin for connection of the link mechanism controlling the rocking range of the rocker cam is supported at the first and second pin support portions at both end portions so as to extend between the first pin support portion of the first split body and the second pin support portion of the second split body, the stress that acts on the first and second split bodies in the separation direction during the valve drive operation can be reduced properly. Namely, the stress can be restrained from concentrating on only one of the split bodies, with the support of the connection pin at the both split bodies. Further, since there may be no need for improperly increasing the rigidity of the rocker cam by increasing its thickness or the like, the rocker cam can be made properly compact.

According to an embodiment of the present invention, the first split body has an extension portion at one end side thereof in an axial direction thereof, the extension portion being configured to extend outward from the second pin support portion of the second split body in the axial direction and to have the first pin support portion facing the second pin support portion at a tip portion thereof, and the link mechanism is disposed via the connection pin on one end side of the rocker cam in an axial direction of the rocker cam.

According to another embodiment of the present invention, the connection pin has an base-end shaft portion with a screw thread and a tip-end shaft portion with a smaller diameter than the base-end shaft portion, either one of the first and second support pin portions has a hole which the tip-end shaft portion of the connection pin fits in and the other has a screw hole which the screw thread of the base-end shaft portion is screwed into, and the connection pin is assembled, by being inserted from a side of the other of the first and second support pin portions with the screw hole through the screw hole, so that the tip-end shaft portion of the connection pin fits in the hole and the screw thread of the base-end shaft portion is screwed into the screw hole, whereby the connection pin can be supported at the first and second pin support portions at both end portions thereof.

Other features, aspects, and advantages of the present invention will become apparent from the following description which refers to the accompanying drawings.

DETAILED DESCRIPTION OF THE INVENTION

Hereinafter, a preferred embodiment of the present invention will be described referring to the accompanying drawings. The embodiment described below just shows an example of the present invention, which should not limit applications or usages of the present invention.

—Whole Structure—

Figure 1:
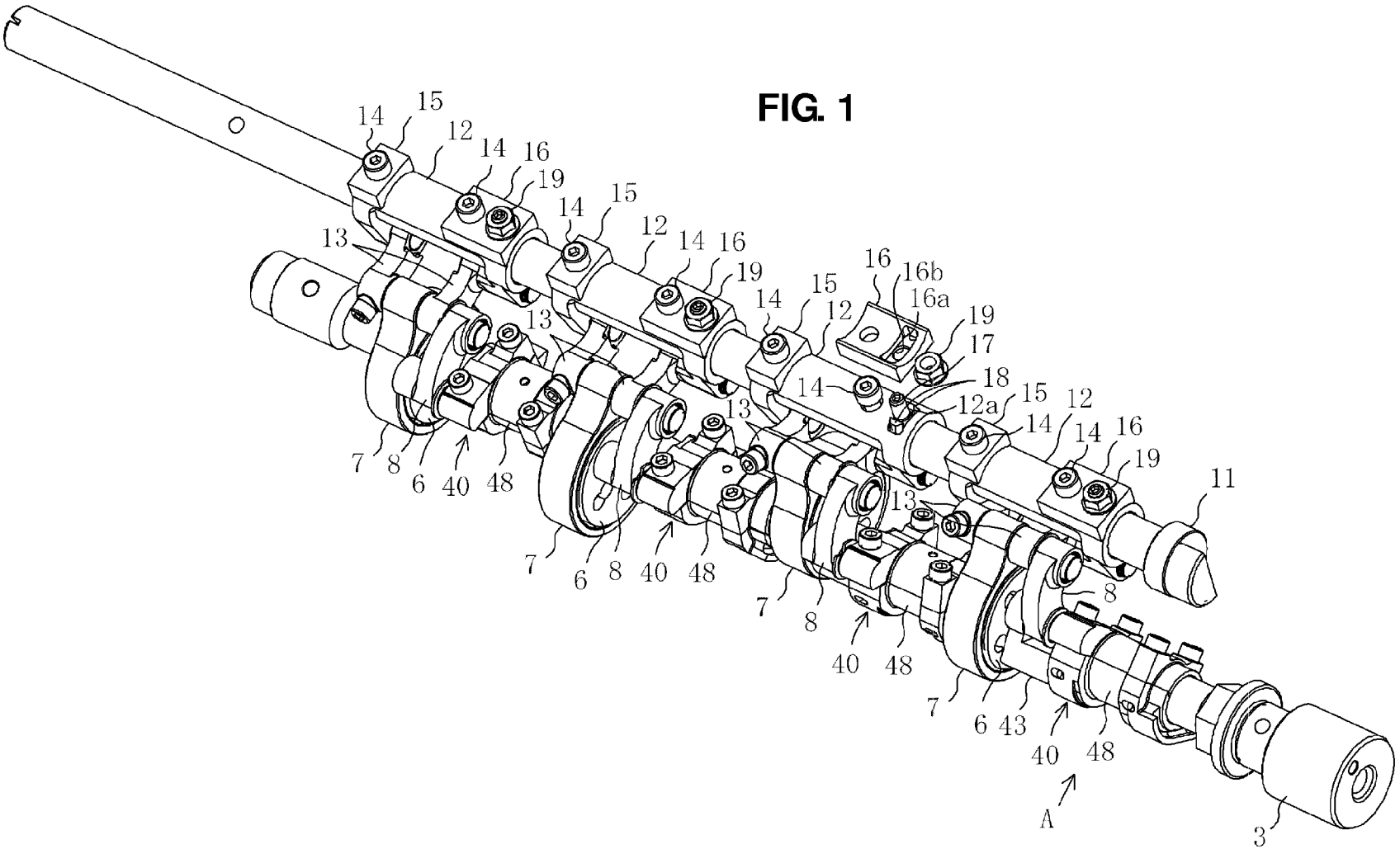
FIG. 1 is a perspective view of an adjustable valve drive device according to an embodiment of the present invention.
Figure 2:
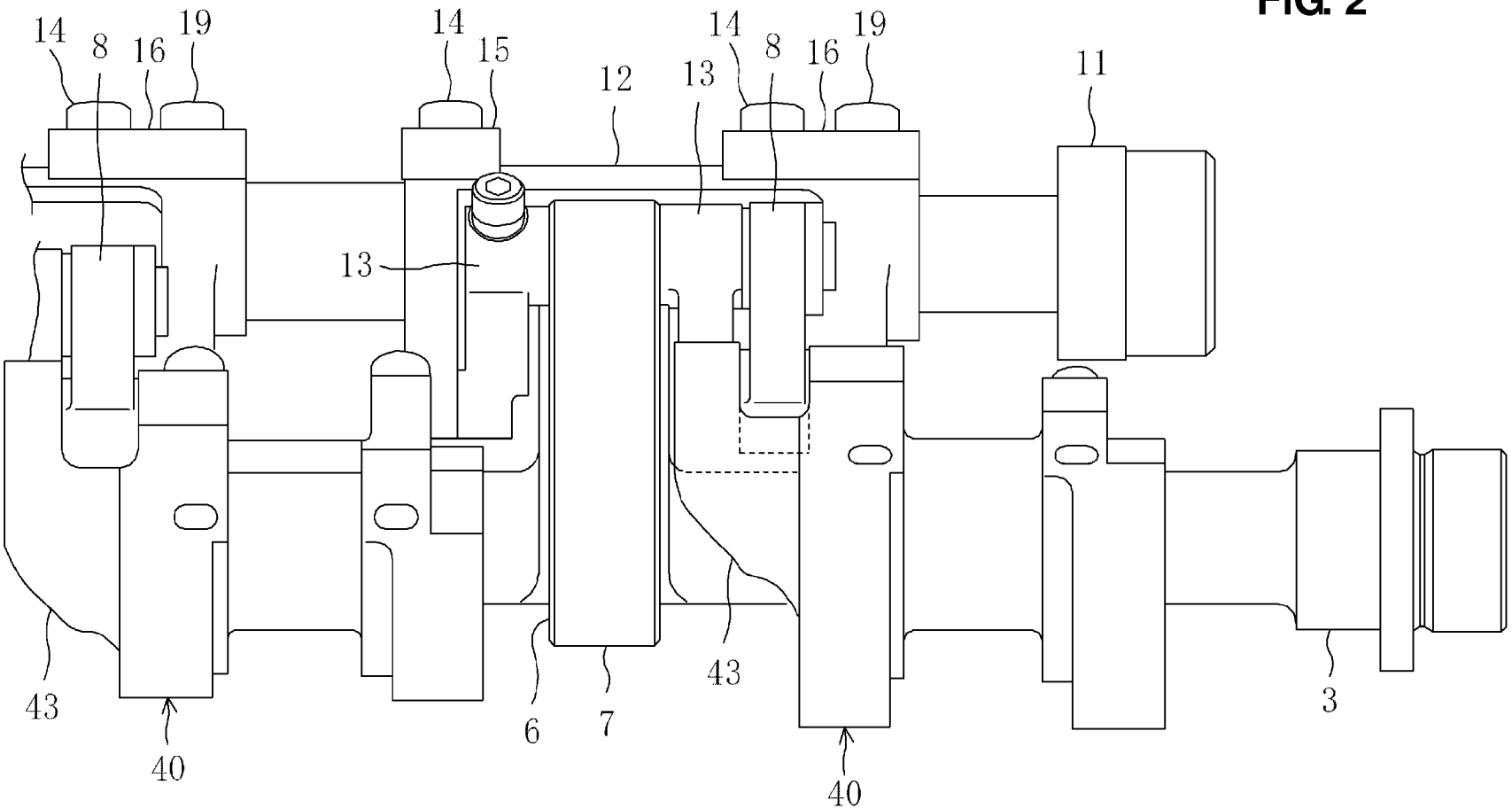
FIG. 2 is a view of the adjustable valve drive device, when viewed in a direction of A.

FIG. 1 is a perspective view of an adjustable valve drive device according to the present embodiment of the present invention. FIG. 2 is a view of the adjustable valve drive device, when viewed in a direction of A.

An engine is a four-valve double-overhead cam type of engine that is equipped with two intake valves 1 (see FIG. 3) and two exhaust valves (not illustrated) for each cylinder as shown in FIGS. 1 and 2.

In FIGS. 1 and 2, a reference character 3 denotes a cam shaft (drive shaft) that rotates synchronously with a crank shaft of the engine. The intake valve 1 is driven by a rocker cam 40 that is supported at the cam shaft 3 so as to be rocking. A valve lift and a valve timing of the intake valve are changeable according to an engine operation state.

For the change of the lift and timing of the intake valve 1, a plurality of eccentric cams 6 are integrally formed with the cam shaft 3 in such a manner that the eccentric cams 6 are located in an axial direction with a specified distance therebetween. At each eccentric cam 6 is provided an outer ring 7 so as to fit onto the eccentric cam 6. The outer ring 7 and the rocker cam 40 are interconnected by a single connection link 8 (link mechanism). The rocker cam 40 is supported at the cam shaft 3 so as to be rocking around the cam shaft 3. Herein, a cylindrical portion 48 of the rocker cam 40 may be supported at a cylinder head or a cam carrier of the engine via a journal member, which are not illustrated here. This constitution is preferable for a smooth rocking movement and a stable support of the rocker cam 40.

Further, a rotational shaft 11 is provided in parallel to the cam shaft 3. On the rotational shaft 11 are provided a plurality of control arms 12 so as to be located in an axial direction with a specified distance therebetween.

A plurality of stud bolts 17 are fixed to the rotational shaft 11 in such a manner that each one end thereof is screwed into a screw hole formed at the shaft 11 and the other end thereof extends outward in a radial direction of the shaft 11 through a through hole 12*a* formed at the control arm 12. Each stud bolt 17 is disposed at an one end of the control arm 12 (at a right-side end in FIG. 1).

The above-described through hole 12*a* of the control arm 12 is of an oval shape having its longer axis extending in a circumferential direction of the arm 12, and a pair of spacers 18, 18 is placed between the stud bolt 17 and the through hole 12*a*. In assembling the rotational shaft 11 and the control arm 12, these spacers 18 with a suitable size are applied after a relative angle of the control arm 12 to the rotational shaft 11 has been properly adjusted. An upper end portion of the spacer 18 projects upward beyond an outer face of the control arm 12.

In a state where the spacer 18 is placed into the through hole 12*a* of the control arm 12, a washer 16 that has an inner peripheral surface, which has substantially the same radius of curvature as an outer peripheral surface of the control arm 12 does, is put over the control arm 12. At the inner peripheral surface of the washer 16 is formed a groove 16*a* that has an oval shape that corresponds to the shape of the above-described through hole 12*a* of the control arm 12. The upper end portion of the spacer 18 is located so as to fit into the groove 16*a*, and the stud bolt 17 projecting upward through the through hole 16*b* of the washer 16 is fastened with a fastening nut 19. FIG. 1 also shows a single washer 16 in its upside-down state where it is removed from the control arm 12 just for explanation. The washer 16 is also fastened with a fastening bolt 14 that is disposed away from the fastening nut 19 with a specified distance in the axial direction. A tip portion of the fastening bolt 14 penetrates the control arm 12 and is fastened to the rotational shaft 11. Thus, the control arm 12 is fastened to the rotational shaft 11.

Meanwhile, a washer 15 that has an inner peripheral surface, which has substantially the same radius of curvature as the outer peripheral surface of the control arm 12 does, is fastened to the other end of the control arm 12 (a left-side end in FIG. 1) with the fastening bolt 14. A tip portion of the fastening bolt 14 penetrates the control arm 12 and is fastened to the rotational shaft 11. Thereby, the control arm 12 is fastened to the rotational shaft 11.

The control arm 12 and the outer ring 7 are interconnected by a control link 13, which controls the displacement of the outer ring 7 according to the rotation of the above-described eccentric cam 6 so that the rocker cam 40 can be rocking.

The rotational shaft 11 is configured to be rotated by a motor, not illustrated, according to the engine operation state and thereby to rotate the control arm 12 so as to change the position of the control link 13 and thereby to change the valve lift and timing of the intake valve 1. In this case, the control arm 12 is controlled so that the valve lift becomes greater as the engine load becomes greater. Hereinafter, the change of the valve lift characteristic according to the adjustable valve drive device will be described specifically.

—Change of Valve Lift Characteristic of Adjustable Valve Drive Device—

Figure 3:
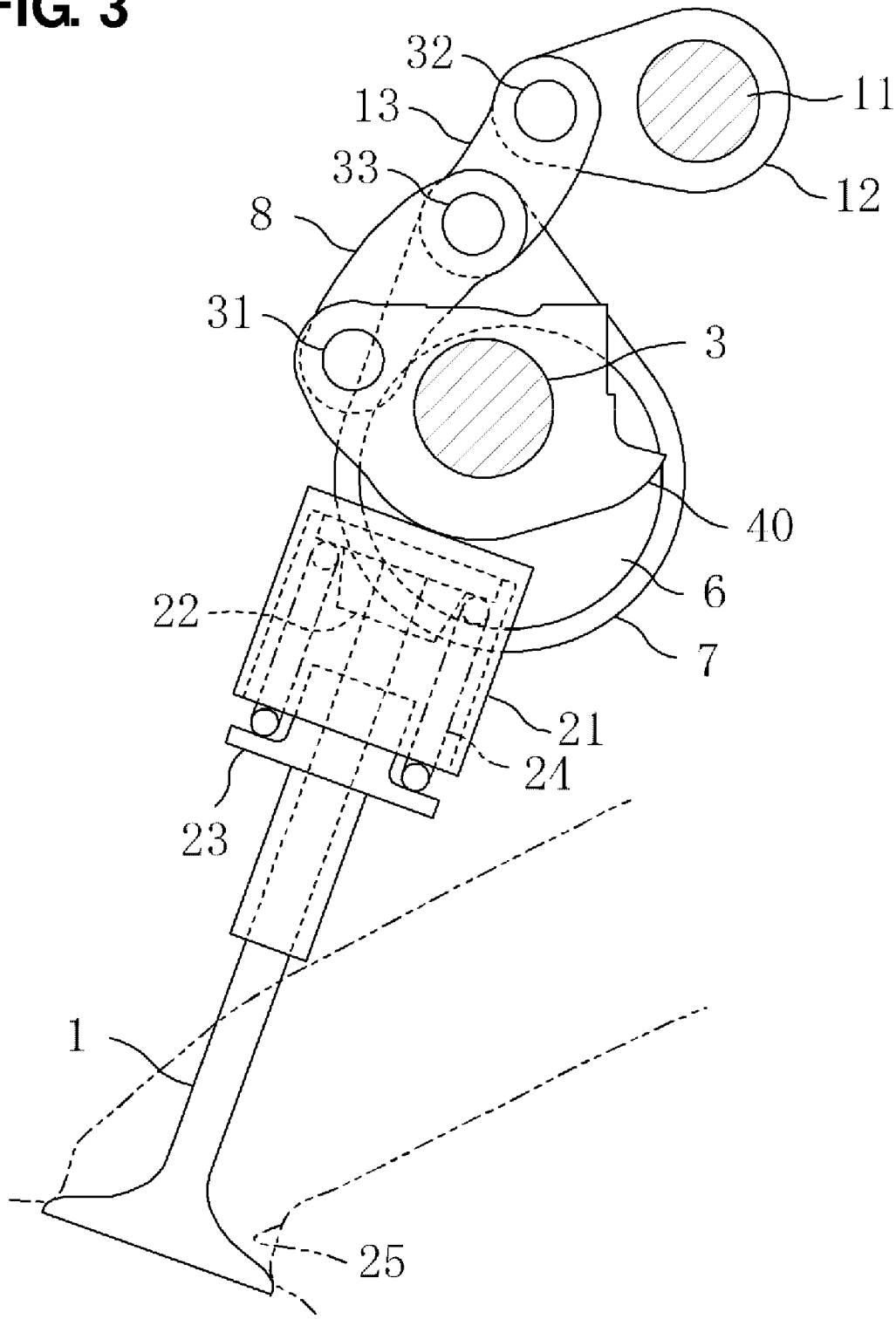
FIG. 3 is a sectional view showing a state of a non-valve lift at a small lift control.

As shown in FIG. 3, a direct drive type of tappet 21 is provided at an upper end of a stem of the intake valve 1 so that the rocker cam 40 contacts the tappet 21. The intake valve 1 is generally biased by a valve spring 24 provided between a retainer 22 provided in the tappet 21 and a retainer 23 provided at the cylinder in a direction of closing an intake port 25.

The above-described connection link 8 is pivotally coupled to the rocker cam 40 via a connection pin 31 at its one end. The control link 13 is pivotally coupled to the tip of the control arm 12 via a connection pin 32 at its one end. Thus, the connection link 8 and the control link 13 are linked via the outer ring 7. Namely, both the other ends of the connection link 8 and the control link 13 are pivotally and coaxially coupled to a projection portion of the outer ring 7, which projects outward, via a connection pin 33. The connection pins 31-33 extend in parallel to the cam shaft 3.

Herein, the rotational direction of the cam shaft 3 (eccentric cam 6) is set to be clockwise in FIG. 3.

The connection pin 33 for coupling the outer ring 7 to the connection link 8 is disposed above the cam shaft 3, and the rotational shaft 11 of the control arm 12 is disposed beside the coupling point. The connection pin 32 at the tip of the control arm 12 is a rotational center of the control link 13. As shown in FIG. 3, the connection pin 32 is moved upward and positioned above the can shaft 3 according to the rotation of the control arm 12, which provides a small-lift control state.

Figure 4:
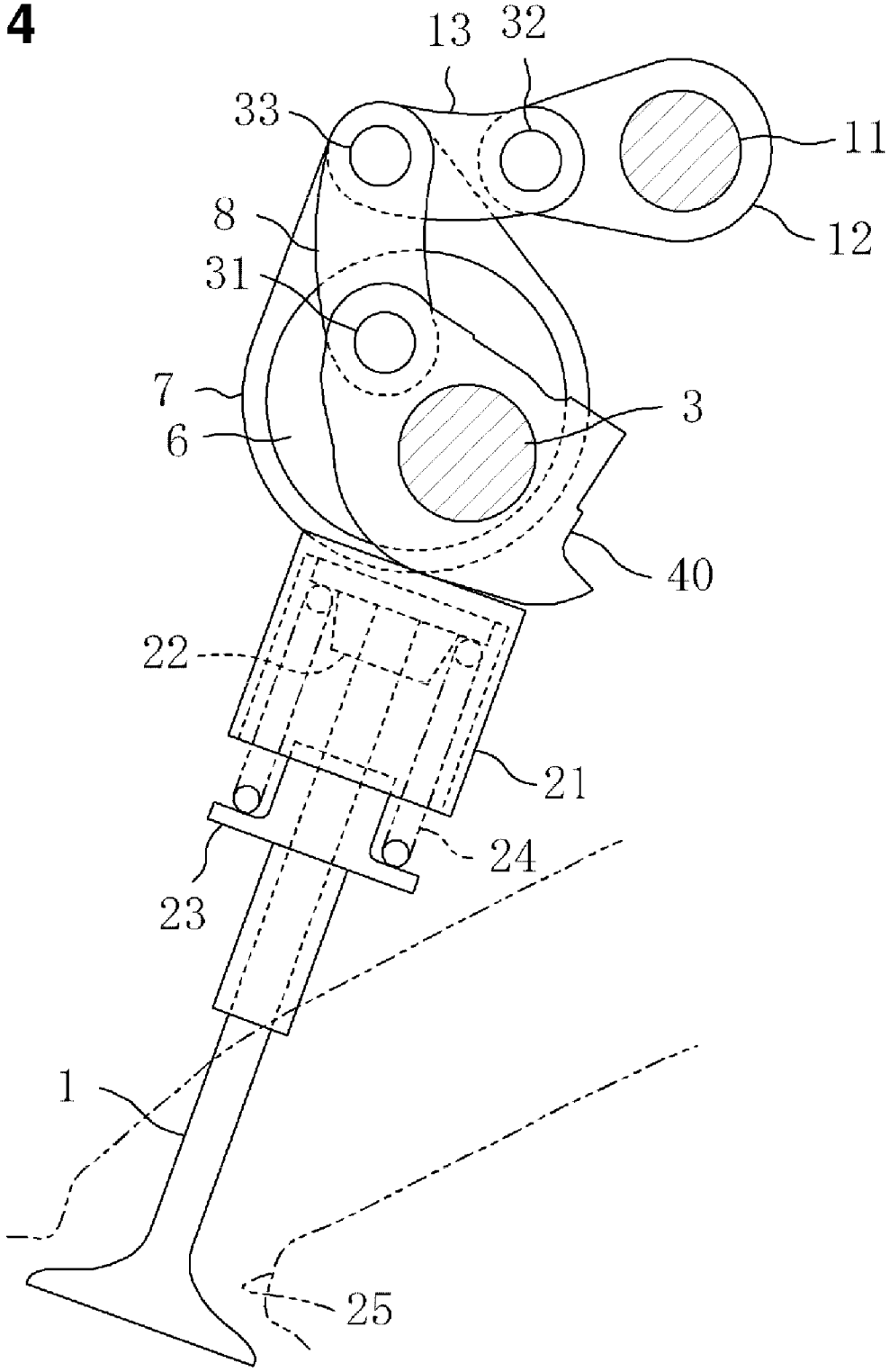
FIG. 4 is a sectional view showing a state of a peak-valve lift at the small lift control.

As shown in FIGS. 3 and 4, the position of the outer ring 7 is changeable according to the rotation of the eccentric cam 6, and the rocker cam 40 is rocking between a non-valve lift state of the intake valve 1 shown in FIG. 3 and a large lift state of the intake valve 1 shown in FIG. 4 (the rocker cam 40 pushes down greatly the valve 1 via the direct-drive type of tappet 21).

Figure 5:
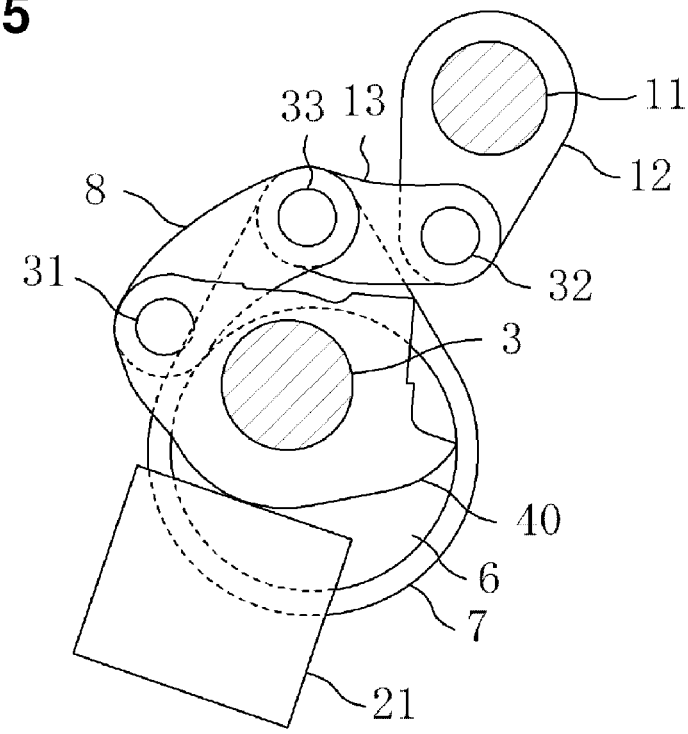
FIG. 5 is a sectional view showing a state of a non-valve lift at a large lift control.

FIG. 5 is a sectional view showing a large-lift control state. As shown in FIG. 5, when the connection pin 32 is moved downward closed to the cam shaft 3 according to the rotation of the control arm 12, the large-lift control state is provided.

In FIG. 5, as the eccentric cam 6 is rotated, the outer ring 7 is moved. Herein, the movement of the outer ring 7 is controlled by the control link 13. Namely, since the control link 13 is rotated around the connection pin 32 disposed below the rotational shaft 11, the connection pin 33 of the outer ring 7 provides its repeated arc-shaped movement around the connection pin 32 when the eccentric cam 6 is rotated.

Figure 6:
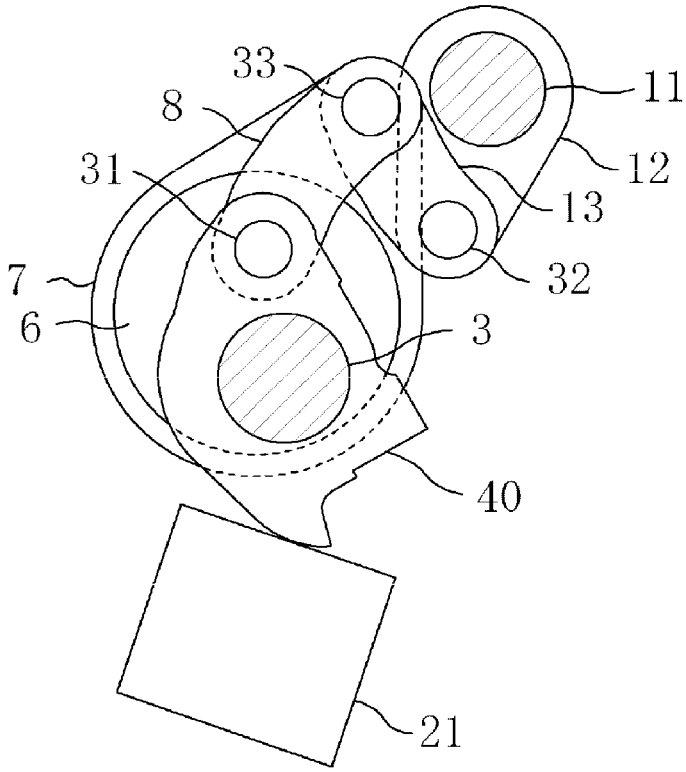
FIG. 6 is a sectional view showing a state of a peak-valve lift at the large lift control.

According to this repeated arc-shaped movement, the rocker cam 40 coupled to the outer ring 7 via the connection link 8 is rocking between the non-valve lift state of the intake valve 1 shown in FIG. 5 and a large lift state of the intake valve 1 shown in FIG. 6 (the rocker cam 40 pushes down greatly the valve 1 via the direct-drive type of tappet 21).

In the state shown in FIG. 5, a base circular face of the rocker cam 40 contacts the tappet 21, so the valve lift is zero (the intake valve 1 is closed). In the state shown in FIG. 6, a tip end of the cam face of the rocker cam 40 contacts the tappet 21, so the valve lift becomes peak (the intake valve 1 is open).

As described above, the connection link 8 and the control link 13 are linked via the outer ring 7. Accordingly, the valve lift controlled by the rocker cam 40 can be changed properly by changing the position of the control link 13 with the control arm 12, thereby providing an appropriate amount of intake air according to the engine operation state with simply adjusting the valve lift. Thus, a pumping loss can be properly reduced without an accelerator valve, and an intake efficiency at the large-lift control can be improved.

—Structure of Rocker Cam—

Figure 7:
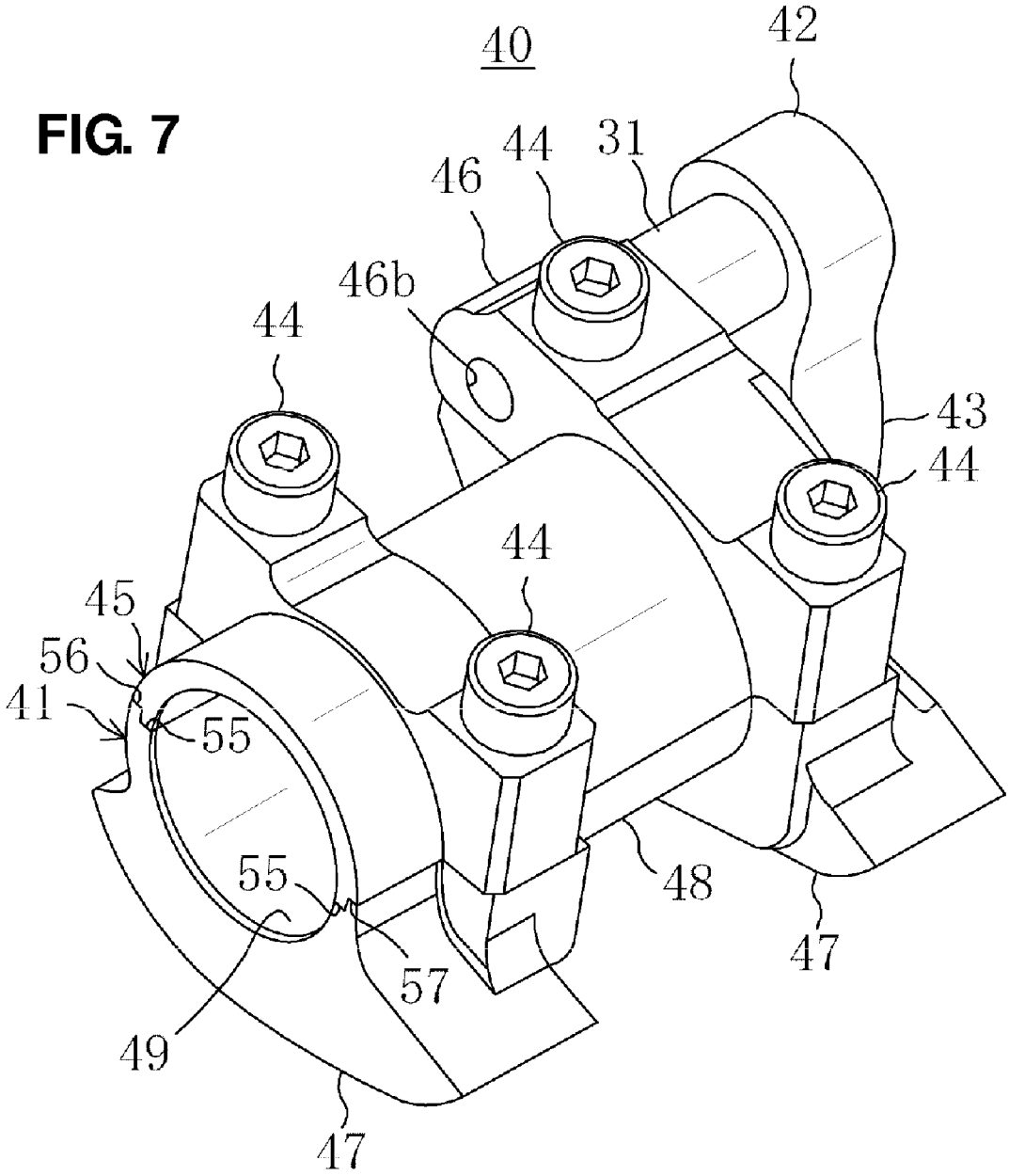
FIG. 7 is a perspective view of a rocker cam.
Figure 8:
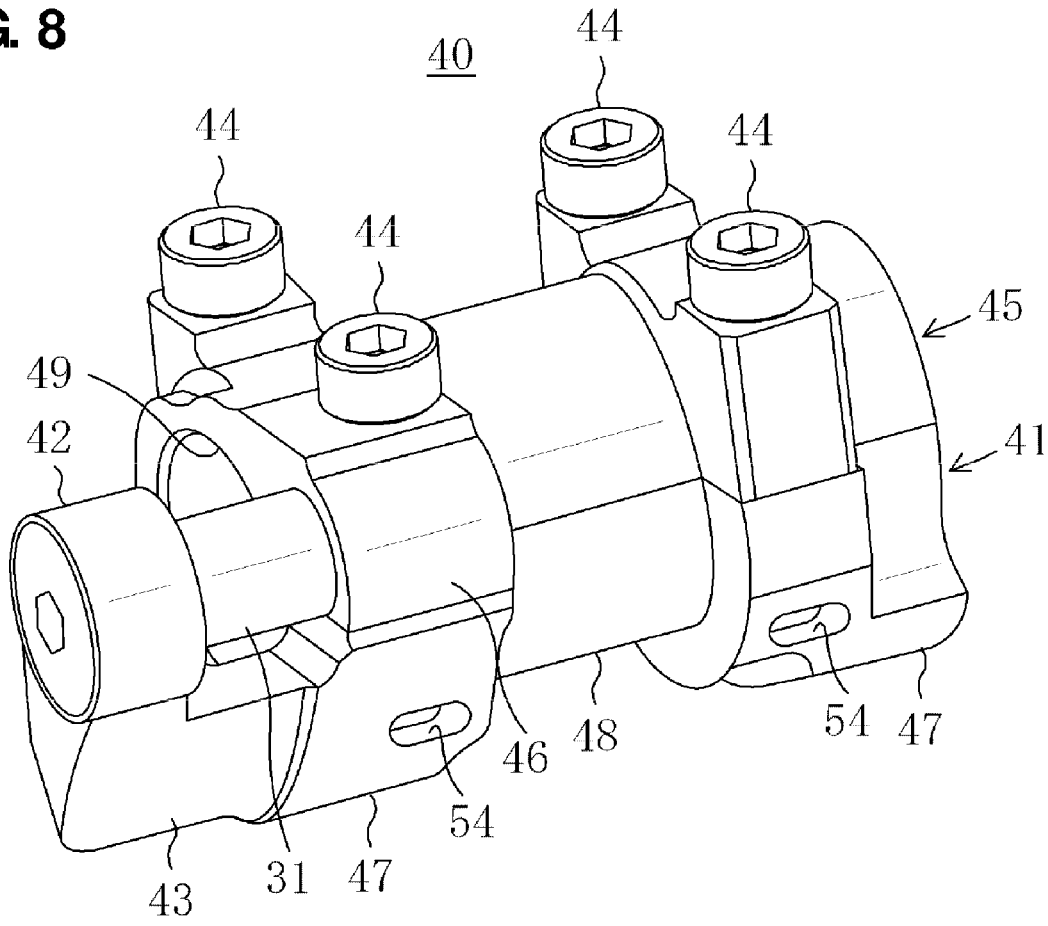
FIG. 8 is a perspective view of the rocker cam, when viewed from a different angle.

FIG. 7 is a perspective view of the rocker cam. FIG. 8 is a perspective view of the rocker cam, when viewed from an opposite direction to that in FIG. 7. As shown in FIGS. 7 and 8, the rocker cam 40 comprises a pair of cam portions 47, 47 that drives the two intake valves 1, 1 (see FIG. 3) and the cylindrical portion 48 that interconnects the both cam portions 47, 47. The rocker cam 40 is comprised of a first split body 41 with a cam profile face and a second split body 45 without a cam profile, which are joined to one another by fastening bolts 44 with a joint split face that is formed so as to contain the axial line of the cam shaft 3. A through hole 49 is formed so as to extend in the axial direction at the cam portions 47, 47 and the cylindrical portion 48 of the rocker cam 40. The cam shaft 3 is provided so as to be inserted into this through hole 49.

Figure 12:
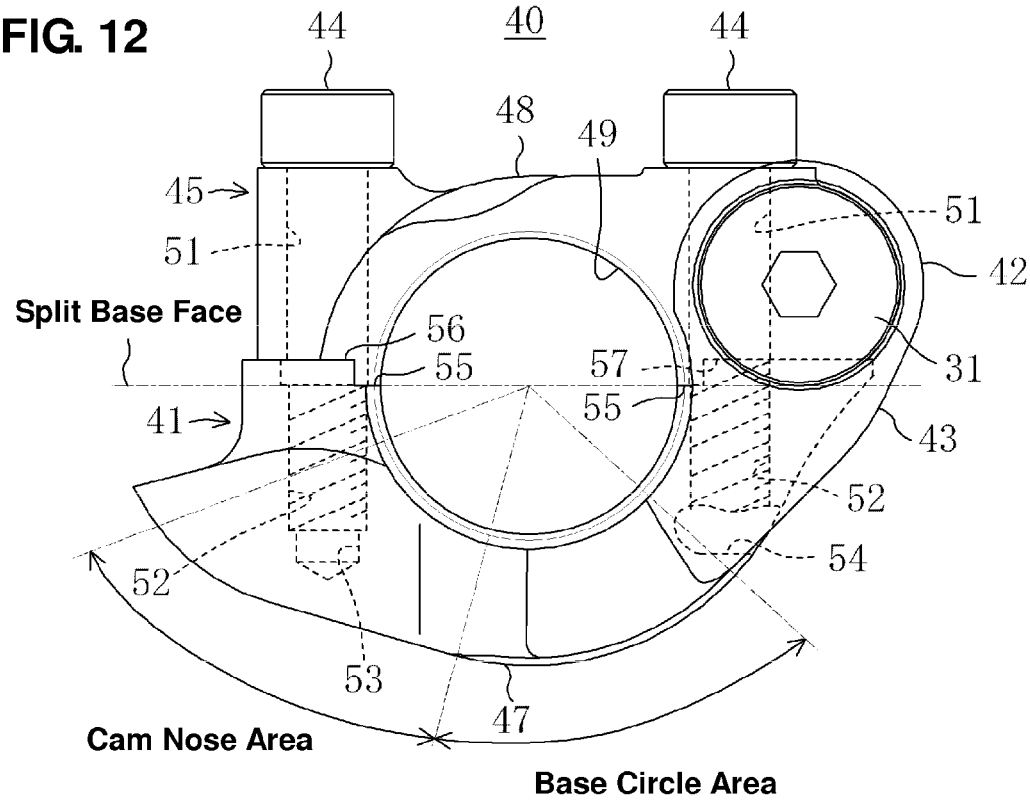
FIG. 12 is a side view of the rocker cam, when viewed in an axial direction.

On the cam profile face of the cam portions 47, 47 of the rocker cam 40 are formed a base circular face (base circle area), where its radius of curvature is the same, from a cam face (cam nose area), where its radius of curvature becomes greater (see FIG. 12).

The first split body 41 has an extension portion 43 at its one end side in its axial direction. The extension portion 43 extends outward from the second split body 45 in the axial direction and has a first pin support portion 42 that supports one end portion of the connection pin 31 coupled to the connection pin 8.

The second split body 45 has a second pin support portion 46 that supports the other end portion of the connection pin 31, facing the first pin support portion 42.

Figure 9:
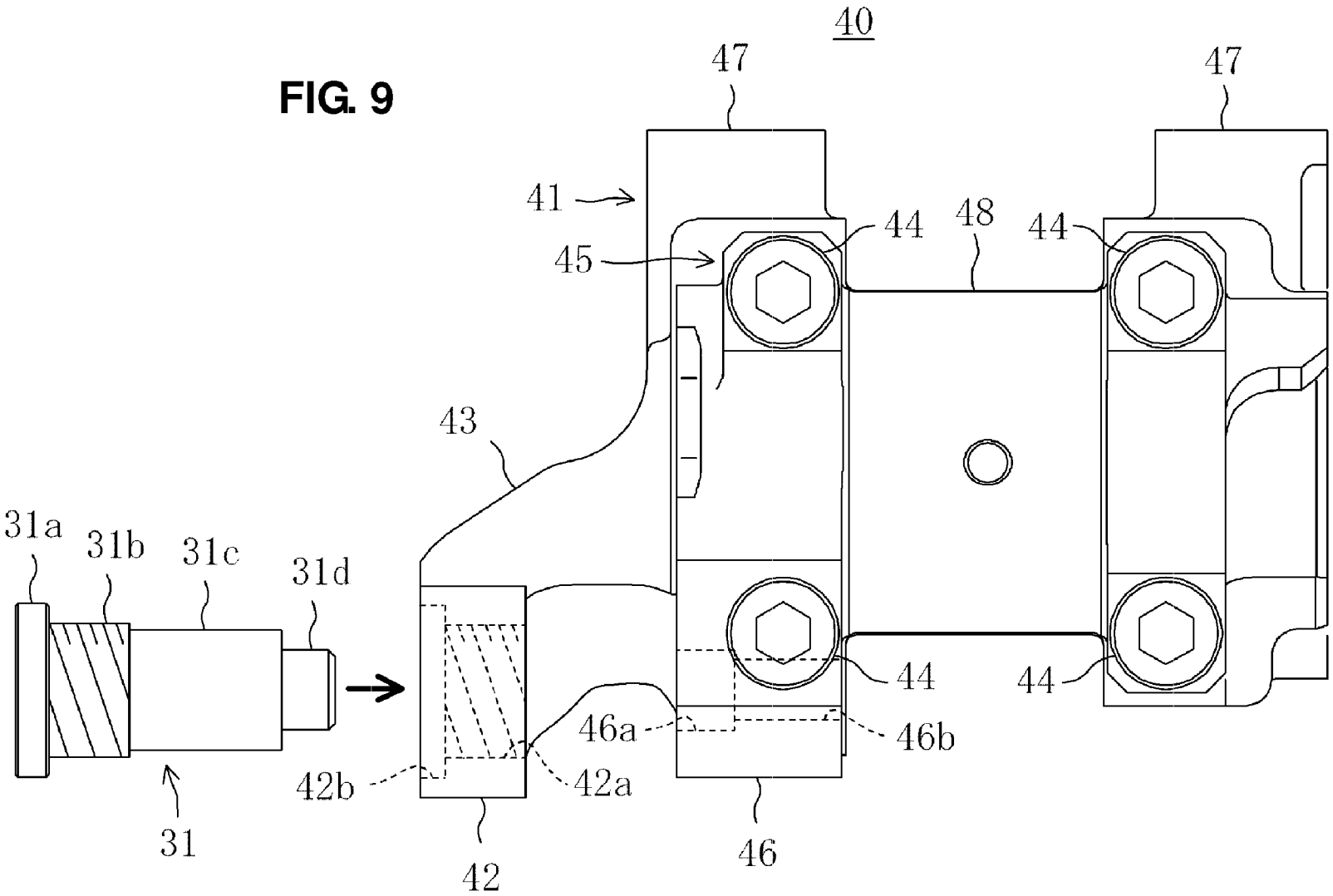
FIG. 9 is an explanatory plan view of assembling of a connection pin to the rocker cam.

FIG. 9 is an explanatory plan view of assembling of the connection pin to the rocker cam. The connection pin comprises, as shown in FIG. 9, a head portion 31*a*, a base-end shaft portion 31*b* that has a smaller diameter than the head portion 31*a* and a screw thread do, a connecting shaft portion 31*c* that has a smaller diameter than the base-end shaft portion 31*b* does and becomes a rotational center of the connection link 8, and a tip-end shaft portion 31*d* that has a smaller diameter than the connecting shaft portion 31*c* does.

The above-described first pin support portion 42 has a screw hole 42*a* which the screw thread of the base-end shat portion 31*b* is screwed into, and a hole 42*b* which the head portion 31*a* fits in. These holes 42*a*, 42*b* are formed in parallel to an axial direction of the through hole 49 of the rocker cam 40. The hole 42*b* has a larger diameter than the screw hole 42*a* does, and it is formed on an insertion side of the connection pin 31 (on the left side in FIG. 9).

The above-described second pin support portion 46 has a hole 46*a* that is formed coaxially with the screw hole 42*a* of the first pin support portion 42 and in which the tip-end shaft portion 31*d* of the connection pin 31 fits, and a hole 46*b* that has a smaller diameter than the hole 46*a* does.

The connection pin 31 is assembled in such a manner that it is inserted into the hole 42*b* and the screw hole 42*a* of the first pin support portion 42, its tip-end shaft portion 31*d* fits in the hole 46*a* of the second pin support portion 46, and the screw thread of the base-end shaft portion 31*b* is screwed into the screw hole 42*a*. Thus, the connection pin 31 is supported at the first and second pin support portions 42, 46 at its both end portions.

Since the connection pin 31 is disposed on one side of the rocker cam 40 in the axial direction of the rocker arm 40, the connection link 8 that is coupled to the rocker cam 40 via the connection pin 31 is likewise disposed on one side of the rocker cam 40 (on the left side in FIG. 1).

Figure 10:
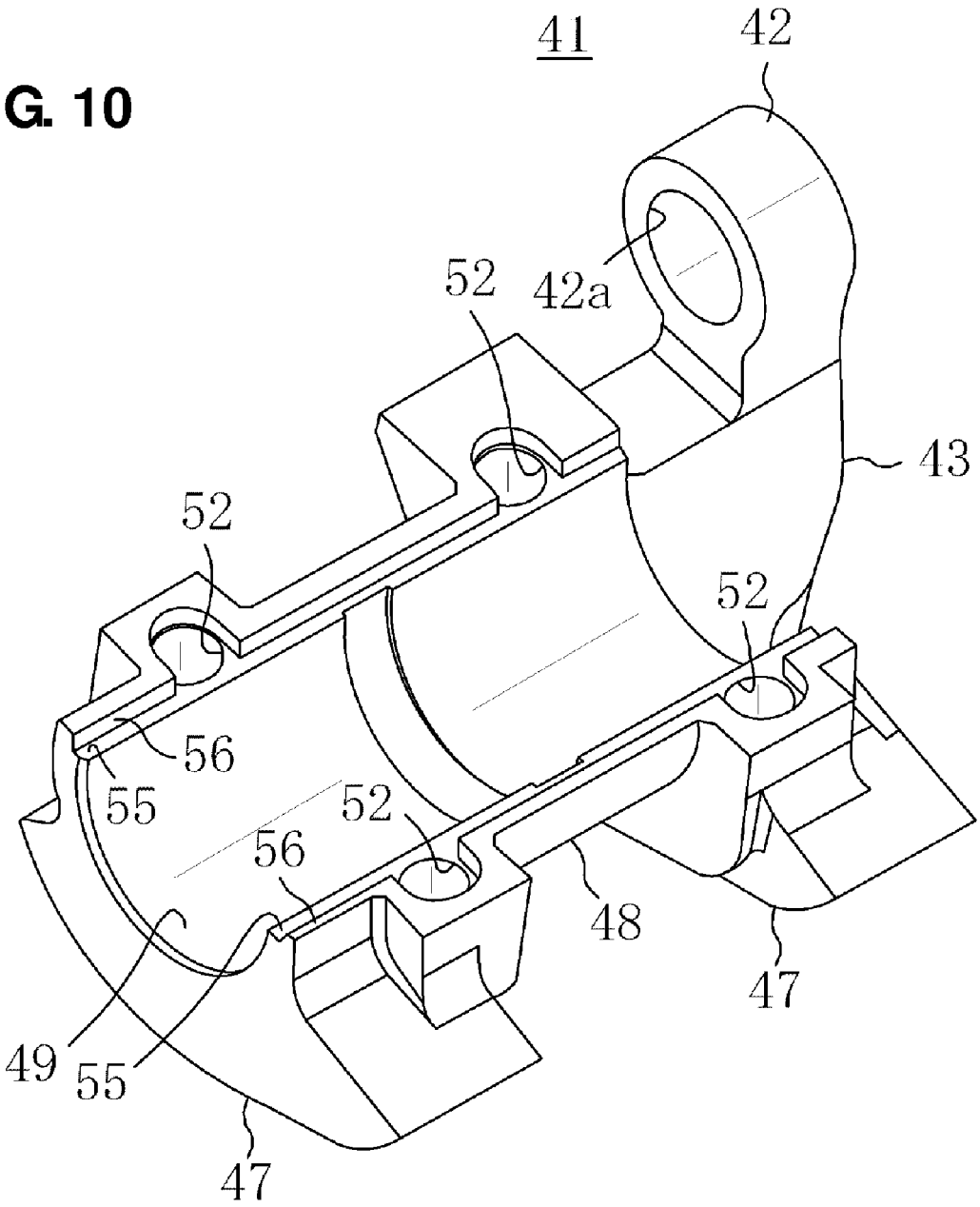
FIG. 10 is a perspective view of a first split body.
Figure 11:
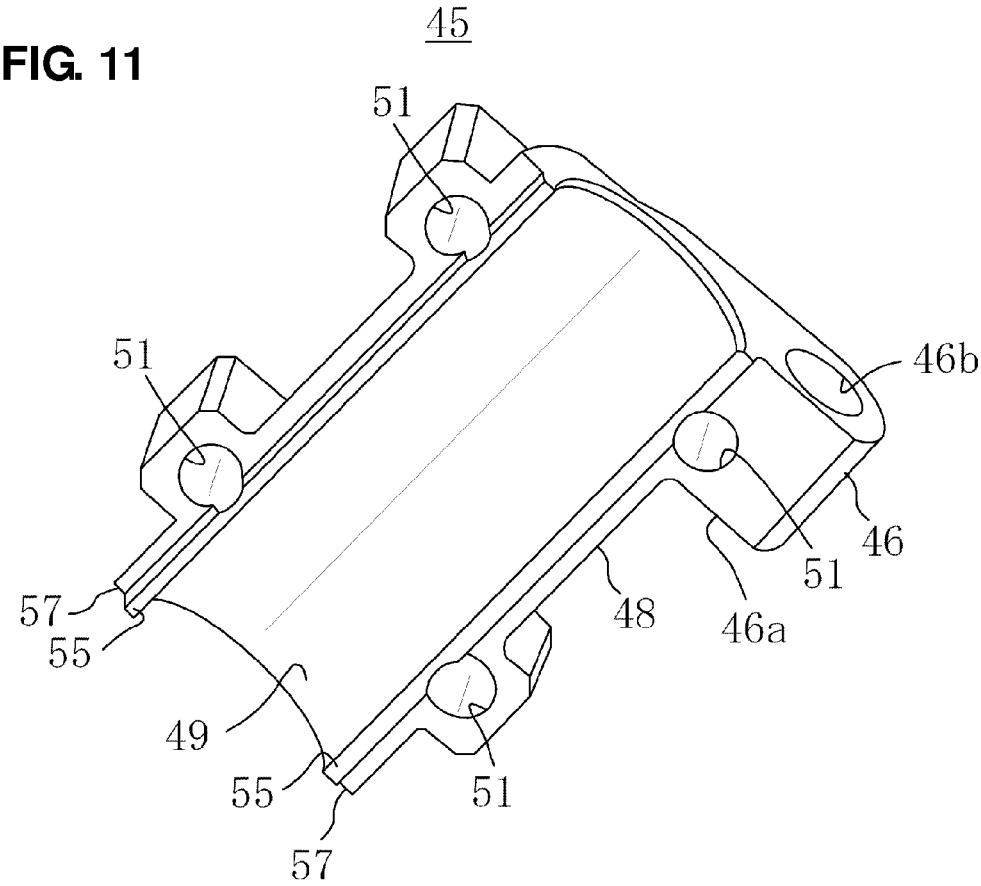
FIG. 11 is a perspective view of a second split body.

FIG. 10 is a perspective view showing the constitution of the split face of the first split body. FIG. 11 is a perspective view showing the constitution of the split face of the second split body. FIG. 12 is a side view of the rocker cam, when viewed in the axial direction.

As shown in FIGS. 10-12, the respective split faces of the first and second split bodies 41, 45 have a difference in level in the radial direction. An inner-side portion of the split face forms split base faces 55 that contain the axial line of the cam shaft 3 thereon. At an outer-side portion of the split face of the first split body 41 are provided projection portions 56 that project from the split base face 55. This projection portion 56 is formed at a longitudinally-entire part of the pair of cam portions 47, 47 and the cylindrical portion 48. Meanwhile, at an outer-side portion of the split face of the second split body 46 are provided recesses portions 57 that are dented from the split base face 5 so as to correspond to the projection portions 56.

Figure 13:
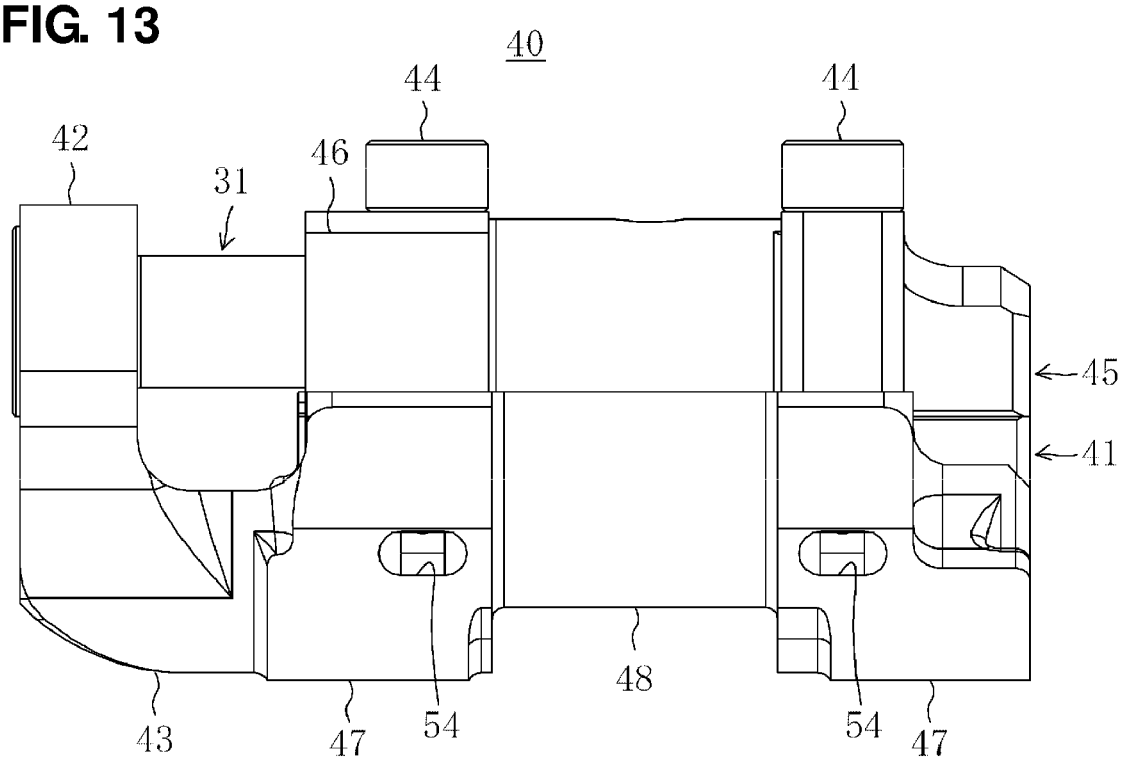
FIG. 13 is an elevation view of the rocker cam.

The first and second split bodies 41, 45 are integrally fastened with the fastening bolts 44 as shown in FIGS. 12 and 13. Specifically, the second split body 45 has through holes 51 that allow shaft portions of the fastening bolts 44 to be inserted therein. The first split body 41 has screw holes 52 that are formed coaxially with the through holes 51 and in which screw threads of the fastening bolts 44 are screwed.

The screw holes 52 of the first split body 41 are formed at locations (four points) where the cam portions 47 are located in the axial direction (see FIG. 10). The screw holes 52, which are formed on the side of the cam face with the greater radius of curvature (cam nose area), have lower holes 53 with their closed bottom, not penetrating the cam nose area (see FIG. 12). Meanwhile, the screw holes 52, which are formed on the side of the base circular face with the same radius of curvature (base circle area), have lower holes 54 that are provided not so as to penetrate the base circle area and to open to a specified area that is located perpendicularly to the axial line of the screw hole 52 and outside the cam profile face (see FIG. 12). Opening of each of the lower holes 54 is of an oval shape having its longer axis extending in the axial direction as shown in FIG. 13.

As described above, according to the adjustable valve drive device of an engine of the present embodiment, since the connection pin 31 for connection of the connection link 8 controlling the rocking range of the rocker cam 40 is supported at the first and second pin support portions 42, 46 at the both end portions so as to extend between the first pin support portion 42 of the first split body 41 and the second pin support portion 46 of the second split body 45, the stress that acts on the first and second split bodies 41, 45 in the separation direction during the valve drive operation can be reduced properly. Further, since there may be no need for improperly increasing the rigidity of the rocker cam 40 by increasing its thickness or the like, the rocker cam 40 can be made properly compact.

The present invention should not be limited to the above-described embodiment, and any other modifications and improvements may be applied in the scope of a sprit of the present invention.

For example, while the present embodiment has described the adjustable valve device of the intake valve, the adjustable valve device according to the present invention can be applied to an exhaust valve. Also, the present invention can be applied to not only the tappet type but a rocker arm type of valve drive device.

What is claimed is:

1. An adjustable valve drive device of an engine, comprising:

a drive shaft provided in parallel to a crank shaft of the engine;

a rocker cam operative to drive a valve, the rocker cam being supported at said drive shaft so as to be rocking; and a link mechanism coupled to a connection pin that is attached to said rocker cam, the connection pin having a pin axis that is provided so as to extend in parallel to said drive shaft, the link mechanism being configured to change a valve lift characteristic by controlling a rocking range of the rocker cam according to an engine operation state, wherein said rocker cam comprises a first split body with a cam profile face and a second split body without a cam profile, which are joined to one another by a fastening bolt with a joint split face thereof that is formed so as to contain an axial line of the drive shaft thereon, the first split body having a first pin support portion that supports one end portion of said connection pin, the second split body having a second pin support portion that is located so as to face the first pin support portion of the first split body and supports the other end portion of said connection pin, whereby the connection pin is supported at said first and second pin support portions at both end portions thereof so as to extend between the first pin support portion of the first split body and the second pin support portion of the second split body.

2. The adjustable valve drive device of an engine of claim 1, wherein said first split body has an extension portion at one end side thereof in an axial direction thereof, the extension portion being configured to extend outward from said second pin support portion of the second split body in the axial direction and to have said first pin support portion facing the second pin support portion at a tip portion thereof, and said link mechanism is disposed via said connection pin on one end side of the rocker cam in an axial direction of the rocker cam.

3. The adjustable valve drive device of an engine of claim 1, wherein said connection pin has an base-end shaft portion with a screw thread and a tip-end shaft portion with a smaller diameter than the base-end shaft portion, either one of said first and second support pin portions has a hole which the tip-end shaft portion of the connection pin fits in and the other has a screw hole which the screw thread of the base-end shaft portion is screwed into, and the connection pin is assembled, by being inserted from a side of the other of the first and second support pin portions with the screw hole through the screw hole, so that the tip-end shaft portion of the connection pin fits in said hole and the screw thread of the base-end shaft portion is screwed into said screw hole, whereby the connection pin can be supported at the first and second pin support portions at both end portions thereof.

* * * * *